United States Patent [19]

Moriguchi et al.

[11] Patent Number: 4,476,179

[45] Date of Patent: Oct. 9, 1984

[54] INK DONOR SHEET

[75] Inventors: Haruhiko Moriguchi; Toshiharu Inui; Takashi Ohmori, all of Kanagawa, Japan

[73] Assignee: Fuji Xerox Co., Ltd., Tokyo, Japan

[21] Appl. No.: 413,205

[22] Filed: Aug. 30, 1982

[30] Foreign Application Priority Data

Aug. 28, 1981 [JP] Japan ..... 56-134027

[51] Int. Cl.[3] ..... B41M 5/26

[52] U.S. Cl. ..... 428/216; 428/211; 428/320.2; 428/321.3; 428/488.4; 428/913; 428/914

[58] Field of Search ..... 428/195, 200, 204, 211, 428/320.2, 488, 537, 913, 914, 216, 321.3, 336

[56] References Cited

FOREIGN PATENT DOCUMENTS 53-3242 6/1978 Japan ..... 428/913

*Primary Examiner*—Bruce H. Hess

*Attorney, Agent, or Firm*—Sughrue, Mion, Zinn, Macpeak, and Seas

[57] ABSTRACT

An ink donor sheet comprising a porous sheet and a heat-fusible ink layer formed on it is disclosed. The ink layer has such temperature-dependent gradation characteristics that it remains solid at ordinary temperatures and when it is heated to a certain temperature its viscosity is suddenly decreased and upon further heating, the viscosity is decreased gradually. The ink donor sheet is capable of producing halftones in the images it creates.

7 Claims, 7 Drawing Figures

INK DONOR SHEET

FIELD OF THE INVENTION

The present invention relates to an ink donor sheet for use in thermal transfer recording wherein a heat-fusible ink layer is selectively heated to be transferred onto a recording sheet. More particularly, the invention relates to an ink donor sheet capable of halftone reproduction.

BACKGROUND OF THE INVENTION

Cross cuts of a conventional ink donor sheet are shown in FIGS. 1 and 2. The sheet consists of a base 1 made of capacitor paper or polyester film and a heat-fusible ink layer 2 formed on the base. The ink layer 2 is selectively heated with a thermal head or other suitable heating means and the fused area is transferred onto the adjacent recording sheet (not shown). In the conventional ink donor sheet, the heated part of ink layer 2 is entirely transferred to the recording sheet as shown in FIG. 2, so the nature of recording is "all or nothing" and halftone reproduction is impracticable.

SUMMARY OF THE INVENTION

The primary object of the present invention is to provide an ink donor sheet capable of halftone reproduction. This object can be achieved by forming on a porous base a heat-fusible ink layer that has temperature-dependent gradation characteristics such that the layer remains solid at ordinary temperatures and when it is heated to a certain temperature, its viscosity is suddenly decreased and upon further heating, the viscosity is decreased gradually.

PREFERRED EMBODIMENT OF THE INVENTION

Figure 1:
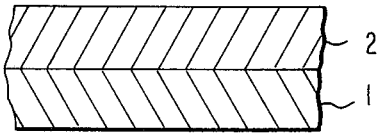
FIG. 1 is a cross sectional view of a conventional ink donor sheet.
Figure 2:
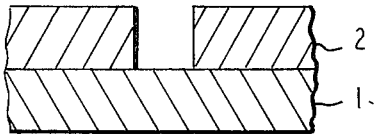
FIG. 2 is a cross sectional view of a conventional ink donor sheet after use wherein a portion of the ink layer is completely removed.
Figure 3:
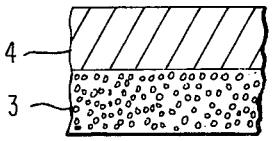
FIG. 3 is a cross sectional view of the ink donor sheet of the present invention.
Figure 4:
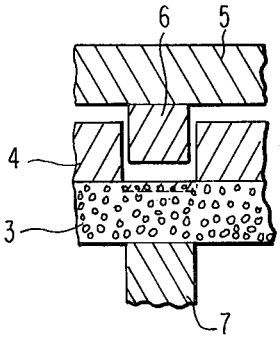
FIG. 4 is a cross sectional view of the ink donor sheet of the present invention applying an ink image to a recording sheet.
Figure 5:
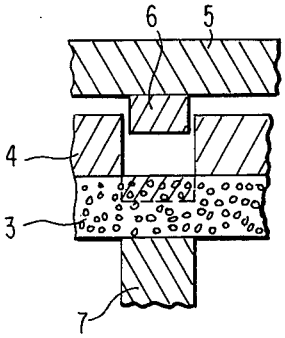
FIG. 5 is a cross sectional view of the ink donor sheet of the present invention applying ink to a recording sheet in a halftone manner.
Figure 6:
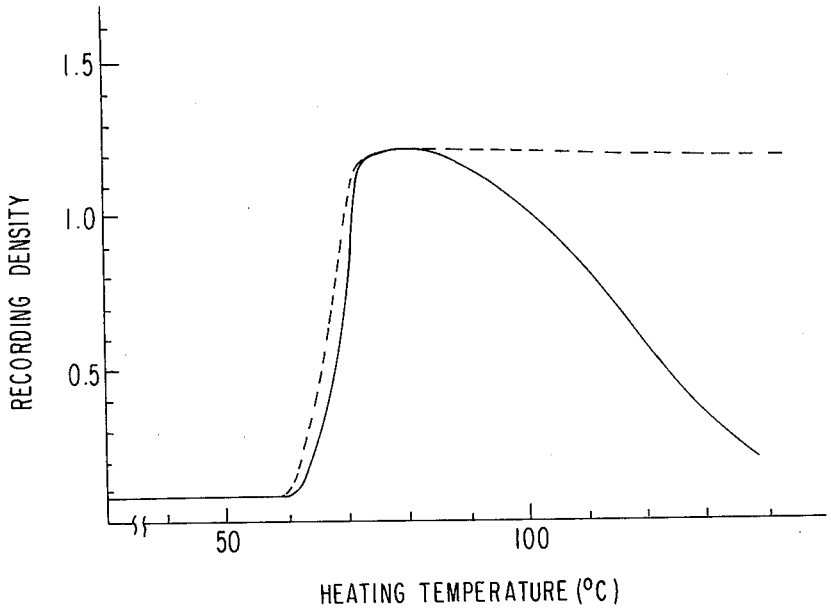
FIG. 6 is a graph showing the relationship between recording density and heating temperature.

One preferred embodiment of the ink donor sheet of the present invention is described by reference to FIGS. 3 to 7. FIG. 3 shows a cross cut of the ink donor sheet of the present invention, FIGS. 4 and 5 schematically show how part of the heat-fusible ink layer heated with a thermal head is transferred onto the recording sheet, FIG. 6 shows the relation between recording density and heating temperature, and FIG. 7 shows the relationship between heating temperature and the viscosity of the heat-fusible ink layer suitable for use in the present invention.

FIG. 3 shows the ink donor sheet of the present invention which is comprised of a porous base 3 and a heat-fusible ink layer 4 formed on top of the base. When the ink layer 4 is heated by a thermal head 7, as shown in FIGS. 4 and 5, the heated part is transferred onto a recording sheet 5 to form an image 6. The dashed line in FIG. 6 shows the density vs. temperature characteristics of the conventional ink donor sheet which consists of a base of capacitor paper or polyester film having thereon a heat-fusible ink layer comprising ester wax, carnauba wax, carbon black and an oil, and the solid line indicates the same characteristics of the ink donor sheet of the present invention.

The porous base 3 is preferably made of a sheet of Japanese tissue paper having a thickness of from about 5 to 20 μm. The base has pores 1 to 100 μm, preferably 5 to 20 μm, in size and the pores are positioned on 20 to 80%, preferably 50 to 70%, of the area of the base.

Figure 7:
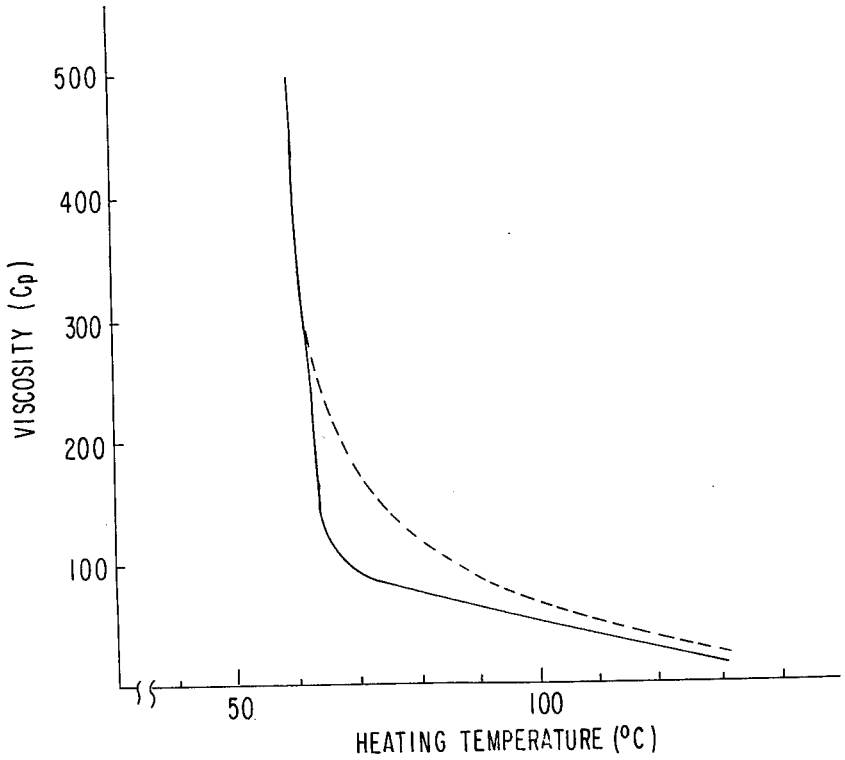
FIG. 7 is a graph showing the relationship between heating temperature and the viscosity of the heat-fusible ink layer.

The heat-fusible ink layer 4 has the temperature-dependent gradation characteristics shown in FIG. 7. The ink layer remains solid at ordinary temperatures (20°-30° C.) and when it is heated to a certain temperature (60°-80° C.), its viscosity is suddenly decreased and upon further heating, the viscosity is decreased gradually. Any conventional ink layer can be used for the ink layer 4 as long as it has temperature-dependent gradation characteristics shown in FIG. 7, such being disclosed in, for example, Japanese Patent Application (OPI) No. 3242/78. In general, the ink layer comprises a binder, a coloring agent and a softening agent. Examples of the binder includes waxes such as carnauba wax, ester wax and microcrystalline wax, and resins such as low molecular weight polyethylene, with carnauba wax and ester wax being preferred. Any coloring agents can be used such as carbon black. Examples of the softening agent includes lubricant oils (e.g., castor oil), polyvinyl acetate, polystyrene, a styrene-butadiene copolymer, cellulose ester, cellulose ethers and acryic resins. Other additives may further be added to facilitate coating of the ink layer and improve storability of the ink donor sheet, such as ethylene vinyl acetate. Specific examples of the formulation of the ink layer 4 are shown in Table 1 below.

TABLE 1

| Ink layer Formulation No. | Binder | | Coloring Agent | | Softening Agent | |
|---|---|---|---|---|---|---|
| | Carnauba Wax | Ester Wax | Dye | Pigment | Lubricant Oil | Others |
| 1 | 20 | 40 | 0 | 20 | 10 | 10 |
| 2 | 20 | 42 | 25 | 0 | 13 | 0 |
| 3 | 20 | 42 | 0 | 25 | 13 | 0 |
| 4 | 17 | 42 | 25 | 0 | 16 | 0 |
| 5 | 24 | 8 | 22 | 0 | 24 | 22 |
| 6 | 20 | 0 | 0 | 50 | 30 | 0 |
| 7 | 25 | 0 | 0 | 50 | 25 | 0 |
| 8 | 30 | 0 | 0 | 50 | 20 | 0 |
| 9 | 34 | 0 | 7 | 23 | 8 | 28 |
| 10 | 0 | 62 | 25 | 0 | 13 | 0 |

(All values in Table 1 are by weight %) Of these, Formulation Nos. 1-7 are particularly preferred.

The ink layer having the formulations are generally formed in a thickness of 2 to 12 μm, preferably 3 to 8 μm, more preferably 3 to 5 μm, on the top surface of the porous base 3 to make an ink donor sheet. As shown in FIG. 7, the viscosity of the ink layer is suddenly decreased when it is heated to a temperature higher than 60° C. At the same time, as shown in FIG. 4, the ink layer is transferred to the recording sheet 5 to form an image. At this stage, the viscosity of the heated part of the ink layer is fairly large, so only a very small part of it is impregnated in the porous base and instead, almost all of it is transferred onto the recording sheet 5 as shown in FIG. 4, to give a fairly high recording density (see FIG. 6).

Upon further heating, the viscosity of the ink layer is decreased gradually as shown in FIG. 7. As a result, more of the heated ink layer is impregnated in the porous base (see FIG. 5) and less ink layer is transferred to the recording sheet to thereby reduce the recording density (see FIG. 6). As is clear from FIG. 6, the ink donor sheet of the illustrated embodiment has a dynamic recording range of from about 75° to 130° C. in terms of the heating temperature. If finer gradation is required, smaller pores are preferably made in the base, and if a thicker ink layer is used, a greater pore volume ratio is preferably used. Finer gradation can be obtained by decreasing the purity of the carnauba wax or ester wax listed in Table 1 or by increasing the proportion of the coloring agent (e.g., carbon black) also indicated in Table 1. This provides a less steep temperature vs. viscosity curve as indicated by the dashed line in FIG. 7.

As described in the foregoing, the ink donor sheet of the present invention comprises a porous base having formed thereon a heat-fusible ink layer. The ink layer has such temperature-dependent gradation characteristics that it remains solid at ordinary temperatures and when it is heated to a certain temperature, its viscosity is suddenly decreased and upon further heating, the viscosity is decreased gradually. Because of this feature, the ink donor sheet of the present invention is capable of halftone reproduction. The conventional ink donor sheet provides a recording density that is increased continuously as more thermal energy is applied. However, the ink donor sheet of the present invention has a maximum recording density, and further application of thermal energy results in decreased density. Most originals have a black-and-white pattern without a halftone area, so they need less thermal energy (lower heating temperatures) to make a copy than originals having a halftone area. Therefore, in most cases, the ink donor sheet of the present invention requires less thermal energy than the conventional ink donor sheet.

While the invention has been described in detail and with reference to specific embodiment thereof, it will be apparent to one skilled in the art that various changes and modifications can be made therein without departing from the spirit and scope thereof.

What is claimed is:

1. An ink donor sheet for transferring an image onto an adjacent recording sheet:

wherein the ink donor sheet has a maximum recording density and application of thermal energy beyond the point of maximum recording density results in an image of decreased density and comprises:

a porous base sheet; and an ink layer on the porous base sheet, the ink layer comprising a binder, a coloring agent and a softening agent and being characterized by a temperature-dependent gradation such that it remains solid at ordinary temperatures, undergoes a sudden decrease in viscosity when heated to a certain temperature to transfer an image to the recording sheet, and undergoes a further gradual decrease in viscosity upon further heating to transfer an image of decreased density to the recording sheet, said ink donor sheet being capable of halftone reproduction.

2. An ink donor sheet as claimed in claim 1, wherein the porous base sheet is Japanese tissue paper having a thickness of about 5 to 20 μm.

3. An ink donor sheet as claimed in claim 1 or 2, wherein the porous base sheet has pores 1 to 100 μm in size, the pores being positioned on 20 to 80% of the area of the base sheet.

4. An ink donor sheet as claimed in claim 3, wherein the porous base sheet has pores 5 to 20 μm in size, the pores being positioned 50 to 70% of the area of the base sheet.

5. An ink donor sheet as claimed in claim 2, wherein the ink layer has a thickness of from 2 to 12 μm.

6. An ink donor sheet as claimed in claim 1, wherein the ink layer has a thickness of from 2 to 12 μm.

7. An ink donor sheet as claimed in claim 1, wherein the porous base sheet is Japanese tissue paper having a thickness of about 5 to 20 μm, the porous base sheet has pores 1 to 100 μm in size, the pores being positioned on 20 to 80% of the area of the base sheet, and the ink layer has a thickness of from 2 to 12 μm.

* * * * *